US005944433A

United States Patent [19]

O'Mara et al.

[11] Patent Number: 5,944,433

[45] Date of Patent: Aug. 31, 1999

[54] PIVOTAL FINGER RETAINER FOR WRITING INSTRUMENT

[76] Inventors: John E. O'Mara, 1845 Joann, Wichita; Ralph E. Lagergren, 1824 Booth, Winfield, both of Kans. 67156

[21] Appl. No.: 09/063,246

[22] Filed: Apr. 20, 1998

Related U.S. Application Data

[60] Provisional application No. 60/044,311, Apr. 24, 1997.

[51] Int. Cl.[6] ..... A46B 5/02

[52] U.S. Cl. ..... 401/8; 401/7

[58] Field of Search ..... 401/8, 7, 6, 221, 401/52, 195

[56] References Cited

U.S. PATENT DOCUMENTS

| | | | |
|---|---|---|---|
| 974,887 | 11/1910 | Huddle | 401/8 |
| 1,094,888 | 4/1914 | Ehrle | 401/8 |
| 1,206,976 | 12/1916 | Barth . | |
| 1,382,487 | 6/1921 | Dixon | 401/8 |
| 1,652,072 | 12/1927 | Vanek . | |
| 2,184,130 | 12/1939 | Tizio . | |
| 2,202,957 | 6/1940 | Martin . | |
| 3,005,441 | 10/1961 | Glasscock . | |
| 3,402,984 | 9/1968 | Zazzara | 401/8 |

FOREIGN PATENT DOCUMENTS

| | | |
|---|---|---|
| 709081 | of 0000 | U.S.S.R. . |
| 1340389 | 5/1971 | United Kingdom . |

*Primary Examiner*—David J. Walczak
*Attorney, Agent, or Firm*—James E. Bradley

[57] ABSTRACT

A writing instrument has a short tubular body which contains a writing implement on each end. A tubular, elastic finger retainer has a small plastic plate which is pivotally mounted to the body. The user of the writing instrument inserts the middle finger of his writing hand through the retainer and slides it to a position between the first and second knuckles. The axis of the body is parallel to the axis of the retainer during use. The thumb of the user pushes outward and downward against the body while the index finger is placed on an upper side of the body. The writing instrument may be pivoted to the other writing implement by applying a twisting force to the body.

14 Claims, 3 Drawing Sheets

PIVOTAL FINGER RETAINER FOR WRITING INSTRUMENT

This appln. claims the benefit of U.S. Provisional application Ser. No. 60/044,311 filed Apr. 24, 1997.

TECHNICAL FIELD

The present invention relates to writing instruments and in particular to a short-barreled writing instrument that is permanently mounted to a finger retainer.

BACKGROUND ART

Various finger-mounted writing instrument holders have been developed or patented to be worn on the wearer's thumb, index, or middle finger. Few of these ring-mounted holders have the writing instrument permanently mounted to or integrally formed with the instrument holder. Instrument holders that have permanently mounted writing instruments have narrow, uncomfortable bands for retaining the writing instrument on the wearer's finger. Typically, the retaining band is narrow and must be adjusted to fit the wearer's finger. The band must also be worn at a particular location on the finger. With the retaining band in place, these prior art types do not allow the user to easily perform tasks other than writing such as typing, keyboarding or filing.

SUMMARY OF THE INVENTION

A writing instrument has a short tubular body which contains a writing implement on each end. A tubular, elastic finger retainer has a small plastic plate which is pivotally mounted to the body. The user of the writing instrument inserts the middle finger of his writing hand through the retainer and slides it to a position between the first and second knuckles. The axis of the body is parallel to the axis of the retainer during use. The thumb of the user pushes outward and downward against the body while the index finger is placed on an upper side of the body. The writing instrument may be pivoted to the other writing implement by applying a twisting force to the body.

DETAILED DESCRIPTION OF INVENTION

Figure 1:
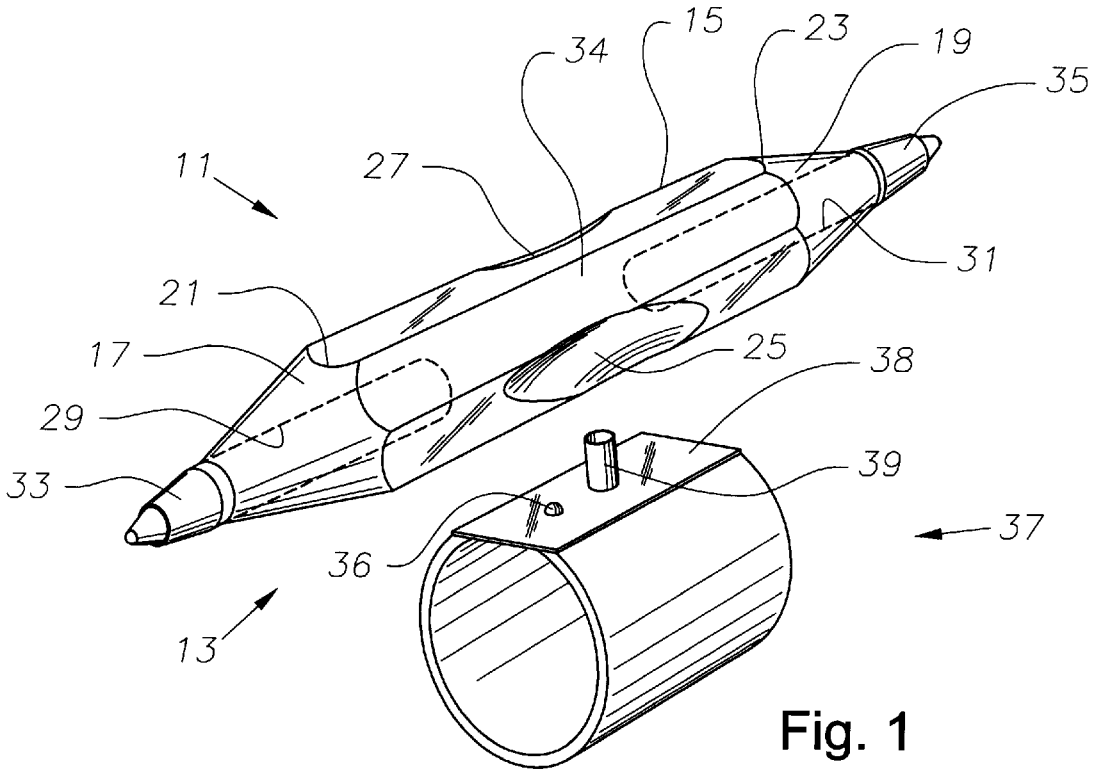
FIG. 1 is an isometric, partially exploded view of a first embodiment of a writing instrument constructed in accordance with the invention.
Figure 2:
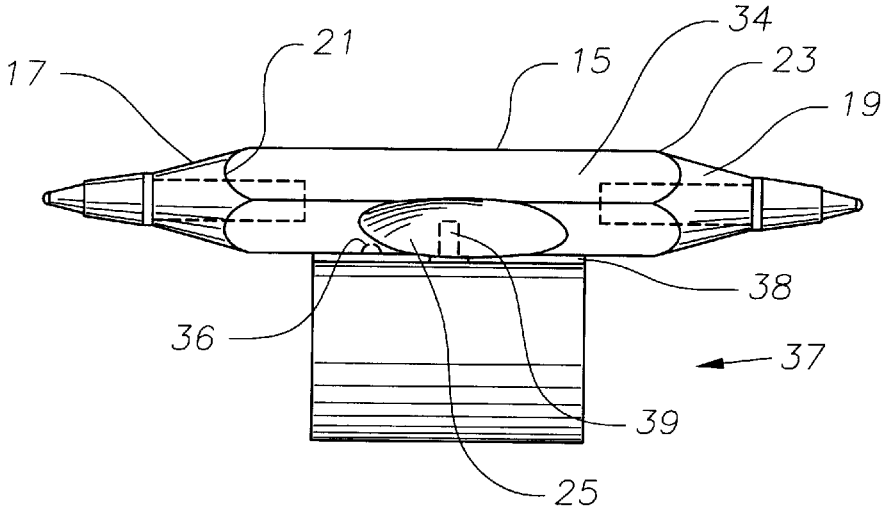
FIG. 2 is a side view of the writing instrument of FIG. 1.
Figure 3:
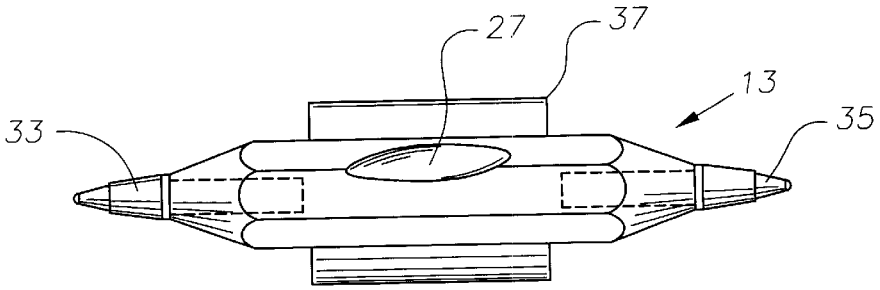
FIG. 3 is a top view of the writing instrument of FIG. 1.

Referring to FIGS. 1–3, a writing instrument 11 having a short-barreled writing element 13 is shown. Writing element 13 has a body portion 15, conical tip or head portions 17 and 19, and circular edges 21 and 23. Body 15 has a length of approximately 2.25 inches, a width of 0.375 inches and a polygonal, flat-sided cross section. Body 15 also has two concave indentations 25 and 27 located opposite of one another. When head 17 is pointing forward, indentation 25 is ergonomically designed for placement of a thumb of the hand while indentation 27 is for an index finger. "Concave" is used generally to refer to a shallow depression and not just part of a spherical surface.

Circular edges 21, 23 define interfaces between body 15 and heads 17 and 19, respectively. Hollow cylindrical bores 29, 31 (FIG. 1) extend from each head 17, 19 for a selected distance into body 15. Writing element 13 is preferably made of thermoformed plastic, but can be made of wood, metal or any other rigid material.

Writing implements 33, 35 are inserted into bores 29, 31, respectively, and permanently secured by a bonding agent such as glue or epoxy (not shown), or by temporary means such as a press fit or threaded screw fit. In the preferred embodiment, writing implements 33, 35 are different colored ballpoint pens, but may also be pencils. Body 15 also has a pair of opposing billboard sides 34 that may be used for graphic design or advertising. A billboard side 34 is always in sight of the user.

Writing instrument 11 also comprises a tubular finger retainer 37. Retainer 37 is a cylindrical band and of sufficient elasticity to provide a snug fit without hindering the user's circulation. Retainer 37 has a circumference of approximately 2.5 inches and an unexpanded width of approximately 0.5 inches. Retainer 37 may comprise other materials such as hook and loop tape.

A small, flat plastic plate 38 is rigidly secured to retainer 37. Plate 38 has a detent or locator pin 36 on an upper surface. The midpoint of body 15 is pivotally mounted to the center of plate 38 by a pivot pin or rivet 39. In one embodiment, pivot pin 39 extends through a hole in plate 38 (not shown) and is rotatable relative to plate 38. The adjoining flat side of writing element 13 has two small, axially-spaced pin holes (not shown). Each of the pin holes are able to pivotally register with detent pin 36 to releasably retain writing element 13 parallel to the axis of retainer 37. The flexibility of retainer 37 allows body portion 15 to twist or rotate a limited extent while pin 36 is still in engagement with a pin hole for better positioning. Pivot pin 39 is stationarily secured in a mating hole in body 15 midway between implements 33, 35 by adhesive or the like.

The user inserts the middle finger of his writing hand through finger retainer 37 and slides retainer 37 to a position between the first and second knuckles. When body 15 is rotated, detent pin 36 will snap into one of the pin holes to hold implement 33 in a parallel position relative to retainer 37. In its natural configuration, the axis of body 15 is parallel to the axis of retainer 37. When writing element 13 is in use, head 17 is adjacent to the tip of the inserted finger. This allows writing implement 33 to extend past the tip of the middle finger while detent pin 36 remains in a pin hole.

Figure 4:
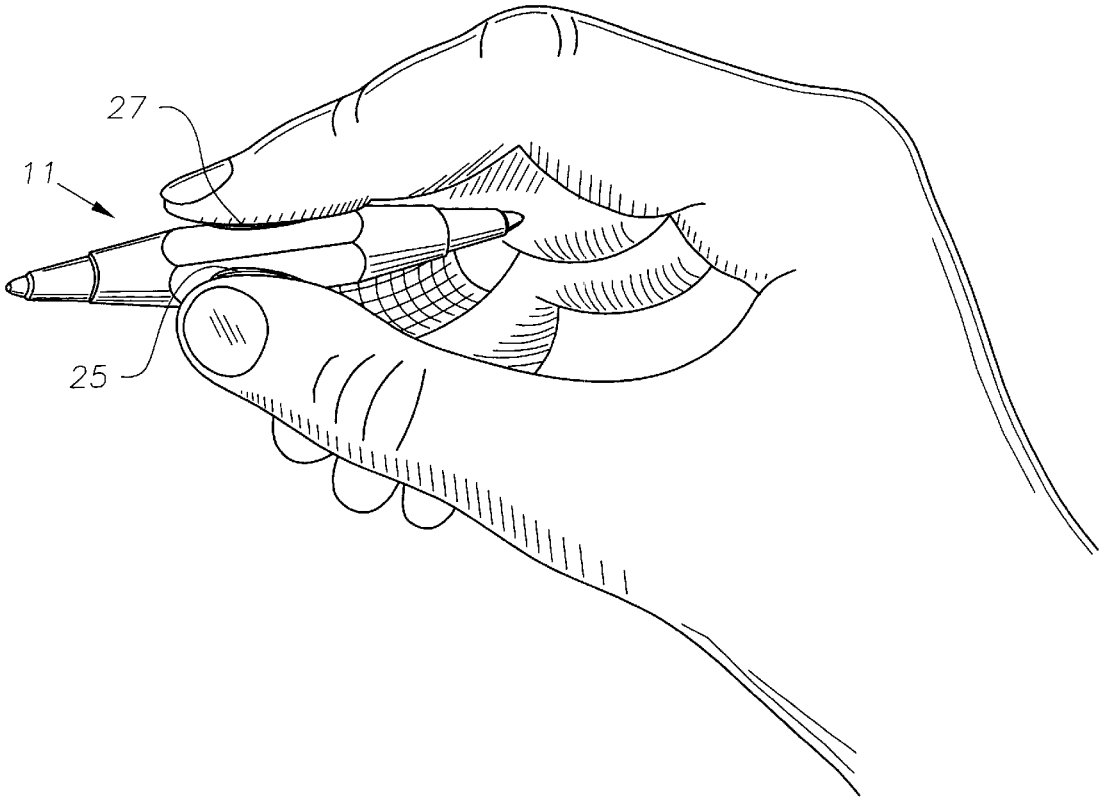
FIG. 4 is a schematic view showing the writing instrument of FIG. 1 in use.

Referring to FIG. 4, the user gently squeezes writing element 13 between the middle finger and thumb. The thumb rests in indentation 25 and pushes outward and downward against body 15. The index finger is placed on an upper side of body 15. Pressure from the tips of the fingers and thumb against body 15 prevents slippage. The middle finger causes tension in the tubular finger retainer 37 and a snug fit around the middle finger is attained.

When writing implement 33 is out of ink or another color is desired, writing element 13 is pivoted about rivet 39 by applying twisting force to writing element 13. Detent pin 36 disengages the original pin hole to allow writing element 13 to pivot or spin 180 degrees. Pin 36 then engages the other pin hole to secure writing element 13 in place. Once writing element 13 is fully pivoted, writing implement 35 is ready for use as described above for writing implement 33.

The elasticity of finger retainer 37 allows writing element 13 to be adjusted to various angles with respect to the middle finger, thereby allowing the user to perform other tasks such as typing, filing, or other office functions while the writing instrument is not in use but still attached to the user's finger. Writing instrument 11 may be worn with writing element 13 on the palm side of the hand to facilitate use by users with limited movement of the fingers, such as those with arthritis. In the embodiment shown, writing instrument 11 is discarded when writing implements 33, 35 run out of ink, or implements 33, 35 can be replaced in instrument 11.

Figure 5:
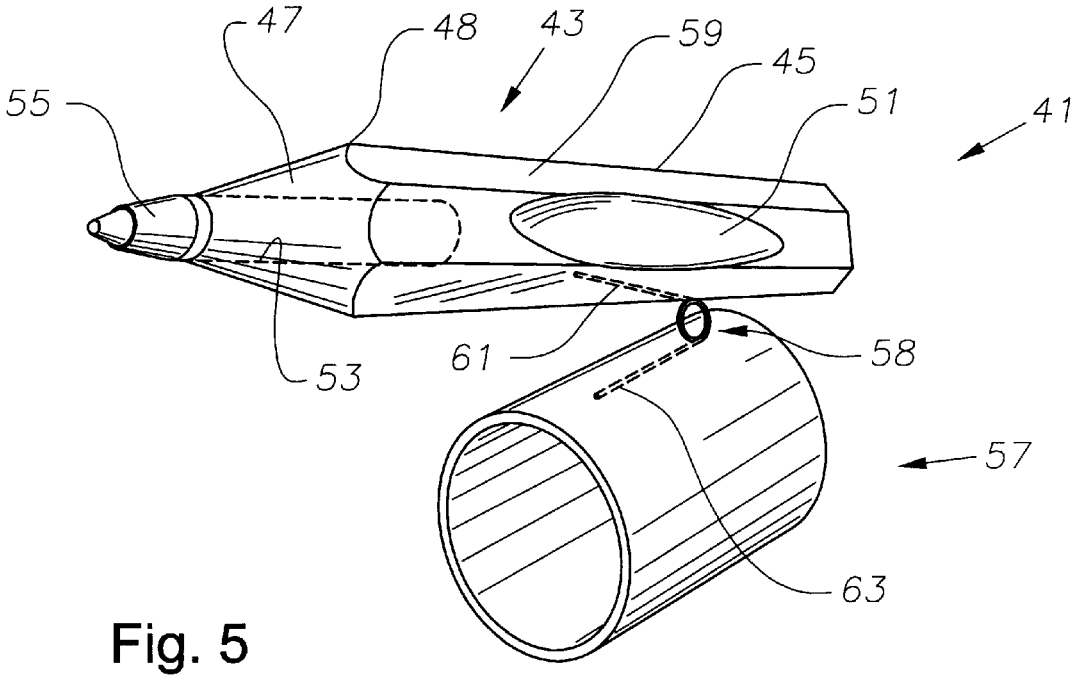
FIG. 5 is an isometric view of a second embodiment of the writing instrument of FIG. 1.
Figure 6:
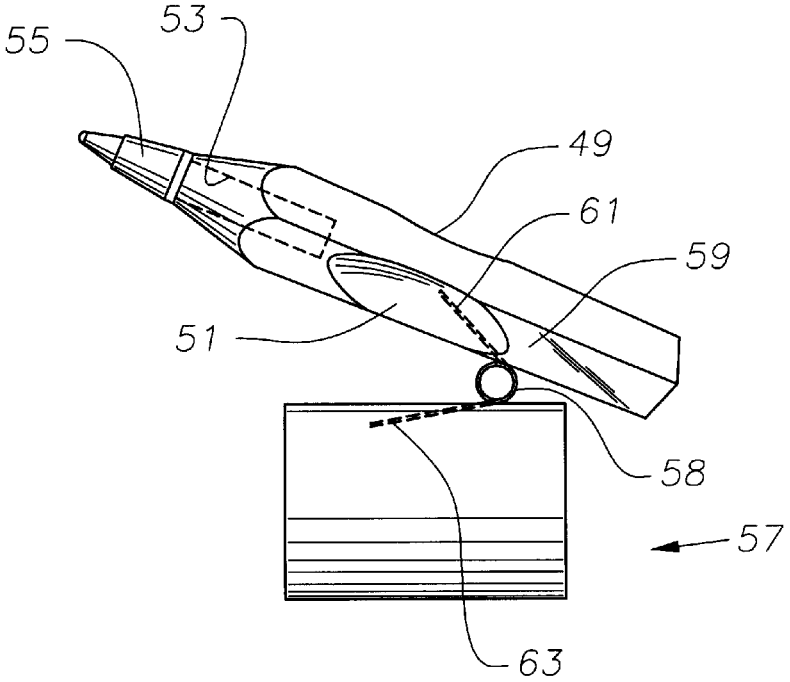
FIG. 6 is a top view of the writing instrument of FIG. 5.

Referring to FIGS. 5 and 6, a second embodiment of the invention is shown. A writing instrument 41 having a short-barreled writing element 43 is shown. Writing element 43 has a body portion 45, a conical tip or head portion 47, and a shoulder 48 therebetween. Body 45 has a length of approximately 2.25 inches and a width of 0.375 inches. Body 45 has two concave sides 49, 51 located opposite of one another. Side 49 is referred to as an outer side, and side 51 is referred to as an inner side. Shoulder 48 is a shallow curved area on a forward end of side 51 and extends from head 47 in a rearward direction. Body 45 tapers in width from the forward end to the rearward end.

A hollow cylindrical bore 53 extends through head 47 and a selected distance into body 45. A writing implement 55 is located and secured within bore 53. Body 45 also has a billboard side 59 that may be used for advertising. Billboard side 59 is always in sight of the user.

Writing instrument 41 is assembled by permanently and pivotally mounting an elastic tubular finger retainer 57 near the rearward end of body 45. Retainer 57 is a cylindrical band having an inner diameter which is smaller than an outer diameter of the finger of the user. Retainer 57 is of sufficient elasticity to provide a snug fit around a user's finger without hindering the user's circulation. Retainer 57 has a circumference of approximately 2.5 inches and an approximate width of 0.5 inches.

The flexibility of retainer 57 allows body portion 45 and writing implement 55 to rotate for a limited extent for better positioning. The rearward end of writing element 43 is located approximately at the rearward edge of retainer 57. Retainer 57 is attached to implement 55 with a hinged spring 58. Spring 58 has two legs 61, 63. Leg 61 is fastened to writing element 43 while leg 63 is fastened to retainer 57.

The user inserts the middle finger of his writing hand through finger retainer 57 and slides retainer 57 to a position between the first and second knuckles. In its natural configuration, spring 58 skews the axis of body 45 to the axis of retainer 57 in order to allow writing element 43 to be positioned at an unobtrusive angle away from the direction of the user's fingers when not in use. During use, the user pivots writing element 43 toward the palm of the hand and into a better writing position by compressing spring 58. When writing element 43 is in line with the middle finger, head portion 47 is adjacent to the tip of the inserted finger. This allows writing implement 55 to extend past the tip of the middle finger.

The user gently squeezes opposing sides 49, 51 between the middle finger and thumb, respectively. The thumb rests against shoulder 48 and pushes outward and downward against body 45. The index finger is placed on an upper side of body 45. Pressure from the tips of the fingers and thumb against shoulder 48 prevents slippage. The middle finger causes tension in retainer 57 and a snug fit around the middle finger is attained. Once pressure by the thumb and index finger is released, spring 58 forces writing element 43 outward with respect to the middle finger, thereby allowing the user to perform other tasks such as typing, filing, or other office functions while writing instrument 41 is not in use. Writing instrument 41 is discarded when writing implement 55 runs out of ink, or implement 55 can be replaced in instrument 41.

The invention has several advantages. The flexible, elastic band is easily secured to and removed from the finger and is adjustable to fit different finger sizes. The writing element is very short and is angled away from the direction of the fingers to minimize interference with non-writing tasks even while being worn. The writing instrument is pivotally mounted to the body and is ergonomically shaped.

It should be apparent from the foregoing that an invention having significant advantages has been provided. While the invention is shown in only two of its forms, it is not so limited but is susceptible to various changes and modifications without departing from the spirit thereof.

I claim:

1. A writing instrument, comprising:

an elongated tubular body having a first end, a second end located opposite the first end, and a first writing implement mounted inside said tubular body and having a tip protruding from the first end of the body and an end portion positioned within said tubular body;

a flexible tubular retained formed in a loop which is adapted to be mounted to a finger of a user for retaining the first writing instrument on a hand of the user; and a pivot pin located between the body and the retainer for providing a pivot point to allow the body to rotate relative to the retainer about a pivot axis defined by the pivot pin.

2. The writing instrument of claim 1, further comprising a plate rigidly secured to the retainer; and wherein the pivot pin extends through a hole in and is rotatable relative to the plate.

3. The writing instrument of claim 1, further comprising an indentation located near a middle portion of the body between the first and second ends for placement of a finger.

4. A writing instrument, comprising:

a tubular body;

a first writing implement mounted in a first end of the body;

a tubular retainer formed in a loop which is adapted to be mounted to a finger of a user for retaining the writing instrument on a hand of the user;

a pivot pin located between the body and the tubular retainer for providing a pivot point to allow the body to rotate relative to the retainer about a pivot axis defined by the pivot pin;

a second writing implement mounted in a second end of the body opposite to the first writing implement; and wherein the pivot pin is located near the midpoint of the body and allows 360 degrees of rotation of the body relative to the retainer so as to selectively position the first writing implement or the second writing implement in a distal position for use.

5. The writing instrument of claim 1 wherein the body has a longitudinal axis which is substantially perpendicular to the pivot axis of the pivot pin.

6. The writing instrument of claim 1 wherein the body and the tubular retainer each have a longitudinal axis;

and wherein the writing instrument further comprises:

a detent for releasably retaining the body and the tubular retainer in a position wherein the axes are parallel.

7. The writing instrument of claim 1 wherein the retainer is formed from an elastic material and has an inner diameter which is smaller than an outer diameter of the finger of the user.

8. A writing instrument, comprising:

a tubular body having a longitudinal body axis;

a first writing implement mounted in a first end of the body;

a second writing implement mounted in a second end of the body opposite to the first writing implement;

a tubular retainer having a longitudinal retainer axis and formed in a loop, the retainer being adapted to be mounted to a finger of a user for retaining the writing instrument on a hand of the user;

a pivot pin located between the body and the tubular retainer for providing a pivot point having a pivot axis near a midpoint of the body to allow the body to rotate 360 degrees relative to the retainer so as to selectively position the first writing implement or the second writing implement in a distal position for use;

a detent for releasably retaining the body and the retainer in a position wherein their axes are parallel; and wherein the body axis is substantially perpendicular to the pivot axis of the pivot pin.

9. The writing instrument of claim 8, further comprising a plate rigidly secured to the retainer; and wherein the pivot pin extends through a hole in and is rotatable relative to the plate.

10. The writing instrument of claim 8, further comprising an indentation in the body for placement of a finger.

11. The writing instrument of claim 8 wherein the retainer is elastic and has an inner diameter which is smaller than an outer diameter of the finger of the user.

12. A writing instrument, comprising:

a tubular body having first and second ends, a body axis and a writing implement mounted inside the first end of the body and having an end portion positioned within said tubular body;

a tubular retainer having a retainer axis and formed into a loop which is adapted to be mounted to a finger of a user for retaining the writing instrument on a hand of the user; and a hinged spring having one leg mounted to the body and another leg to the retainer for allowing the body to pivot relative to the retainer, wherein, when the spring is in a released position, the axes of the body and the retainer are skewed relative to each other at an acute angle and the spring has a V-shaped configuration, and when the spring is in a compressed position, the axes of the body and the retainer are essentially parallel.

13. The writing instrument of claim 12, further comprising an indentation in the body for placement of a finger.

14. The writing instrument of claim 12 wherein the retainer is formed from an elastic material and has an inner diameter which is smaller than an outer diameter of the finger of the user.

* * * * *